US005478715A

United States Patent [19]

Ohzeki et al.

[11] Patent Number: 5,478,715

[45] Date of Patent: Dec. 26, 1995

[54] SILVER HALIDE PHOTOGRAPHIC MATERIAL

[75] Inventors: Tomoyuki Ohzeki; Shinji Ikari, both of Kanagawa, Japan

[73] Assignee: Fuji Photo Film Co., Ltd., Kanagawa, Japan

[21] Appl. No.: 260,399

[22] Filed: Jun. 14, 1994

Related U.S. Application Data

[63] Continuation-in-part of Ser. No. 96,402, Jul. 26, 1993, abandoned.

[30] Foreign Application Priority Data

Jul. 24, 1992 [JP] Japan ..... 4-218433

[51] Int. Cl.[6] ..... G03C 1/09; G03C 1/04

[52] U.S. Cl. ..... 430/567; 430/569; 430/604; 430/605; 430/612; 430/627; 430/629; 430/630

[58] Field of Search ..... 430/567, 569, 430/604, 605, 627, 628, 629, 630, 612

[56] References Cited

U.S. PATENT DOCUMENTS

| | | | |
|---|---|---|---|
| 3,690,888 | 9/1972 | Bacon et al. | 430/629 |
| 3,861,918 | 1/1975 | Fitzgerald | 430/628 |
| 3,879,205 | 4/1975 | Fitzgerald et al. | 430/627 |
| 4,022,623 | 5/1977 | Fitzgerald et al. | 430/630 |
| 4,120,727 | 10/1978 | Fitzgerald | 430/627 |
| 4,131,471 | 12/1978 | Fitzgerald | 430/627 |
| 4,315,071 | 2/1982 | Fitzgerald | 430/627 |
| 4,879,208 | 11/1989 | Urabe | 430/567 |
| 4,937,180 | 6/1990 | Marchetti et al. | 430/604 |
| 5,112,732 | 5/1992 | Hayashi et al. | 430/604 |
| 5,132,203 | 7/1992 | Bell et al. | 430/567 |
| 5,204,234 | 4/1993 | Asami | 430/604 |

FOREIGN PATENT DOCUMENTS 0508910 10/1992 European Pat. Off. .

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halide photographic material comprising a support and a silver halide emulsion layer provided thereon. The silver halide emulsion is prepared by nuclear formation, crystal growth and chemical sensitization. All or a part of the nuclear formation or the crystal growth is conducted in the presence of a hexa-coordinated cyano-complex to introduce the complex into crystal lattice of the silver halide. The density of the hexa-coordinated cyano-complex contained in surface parts of silver halide grains is in the range of $10^{-4}$ to $10^{-2}$ mol per 1 mol of silver. The surface parts of silver halide grains has a thickness of not more than 20Å from the surfaces of the grains. The chemical sensitization is conducted using a gold sensitizer. The silver halide emulsion is prepared using a synthetic polymer as a protective colloid in place of gelatin. In the cases in which gelatin is used, it is present in an amount of not more than 10 g per 1 mol of silver.

11 Claims, No Drawings

SILVER HALIDE PHOTOGRAPHIC MATERIAL

CROSS-REFERENCE TO RELATED APPLICATION

This is a continuation-in-part application of U.S. Patent Application Ser. No. 08/096,402 filed on Jul. 26, 1993, now abandoned.

FIELD OF THE INVENTION

The present invention relates to a silver halide photographic material. The invention particularly relates to a photographic material using a silver halide emulsion of high sensitivity, which is particularly improved in the spectral sensitivity. The emulsion has excellent characteristics, such as reduced high intensity reciprocity law failure, high contrast and high sensitivity to intrinsic absorption. Further, the emulsion is hardly desensitized with spectral sensitizing dyes.

BACKGROUND OF THE INVENTION

In preparation of a silver halide emulsion, a dopant (i.e., substances other than silver and halogen ion) is sometimes introduced into silver halide crystals, which has been well known as a doping technique. The doping technique of transition metals (III to XII groups in the periodic table) has particularly been studied to improve a silver halide emulsion. For example, U.S. Pat. No. 2,448,060 (Trivelli et al) describes that the silver halide emulsion is sensitized with a transition metal compound of $R_2MX_6$ (in which R is hydrogen, an alkaline metal or ammonium group; M is trivalent palladium or platinum; and X is halogen). The metal compound may be added to the emulsion at any stages of preparation, namely on or before precipitation of silver halide, on or before the first ripening (physical ripening), or on or before the second ripening (chemical sensitization).

A transition metal compound can be added to the silver halide emulsion at the stage of grain formation. The compound may also be added to the emulsion after precipitation of silver halide grains. However, there is a considerable difference in a photographic effect between the former and latter additions. In the former addition, the transition metal of the compound is introduced into the silver halide crystal as a dopant. Therefore, the transition metal can effectively change the photographic properties of the emulsion, even if a small amount of the compound is used. On the other hand, the transition metal is adsorbed on the surface of the silver halide grains in the latter addition. In this case, a relatively large amount of the transition metal compound is required to change the photographic properties of the emulsion to the same extent as the former addition, since the function of the transition metal to the silver halide grains is inhibited by a protective colloid. Accordingly, it is difficult to obtain a satisfactory photographic effect, if the transition metal is added to the emulsion at the stage of chemical sensitization. Therefore, the transition metal has been usually added as a dopant to the emulsion at the stage of silver halide grain formation. As is described above, metal doping (the former addition) is different from metal sensitization (the latter addition).

Research Disclosure, vol. 176 (December 1978) describes the technical difference between the metal doping and the metal sensitization. In more detail, the chapter IA of the item 17,643 discloses transition metal compounds, which may be added to the emulsion at the stage of precipitation of silver halide grains. On the other hand, the chapter IIIA discloses transition metal compounds, which may be added to the emulsion added during chemical sensitization are described in Chapter IIIA of that publication.

U.S. Pat. No. 3,790,390 discloses use of simple salts of metals or hexa-coordinated complexes thereof having six cyano ligands. The metals are selected from the fourth period in the periodic table (e.g., iron, cobalt, nickel). U.S. Pat. No. 3,790,390 also discloses use of simple salts of ruthenium, rhodium, palladium, osmium or iridium or hexa-coordinated complexes thereof having six halogen ligands. U.S. Pat. No. 3,790,390 further describes silver halide emulsions containing hexa-coordinated complexes of iron(II), iron(III) and cobalt(III).

U.S. Pat. No. 4,126,472 discloses use of iridium as a dopant attached to the surface of silver halide grain or as a surface modifier for silver halide. According to the description of U.S. Pat. No. 4,126,472, silver halide emulsion is sensitized in the presence of a water-soluble iridium salt. The amount of the salt is $10^{-6}$ to $10^{-4}$ mol per 1 mol of silver halide. However, U.S. Pat. No. 4,126,472 is silent with respect to hexa-coordinated cyano complex.

European Patent No. 0,242,190 describes that high intensity reciprocity law failure is reduced in a silver halide emulsion containing silver halide grains, which are formed in the presence of rhodium(III) complex having 3, 4, 5 or 6 cyano ligands.

U.S. Pat. No. 3,690,888 discloses a process for preparing silver halide containing multivalent metal ions. In the process, silver halide is formed in the presence of protective colloid mainly comprising acrylic polymer. U.S. Pat. No. 3,690,888 that the multivalent metal ions include bismuth, iridium, lead and osmium. However, U.S. Pat. No. 3,690,888 is silent with respect to hexa-coordinated cyano complex.

The above-mentioned publications do not disclose that the ligands are introduced into a grain together with the transition metal. Further, they are silent with respect to regulation of the ligand and the effect of the transition metal complex.

European Patents No. 0,242,190 and No. 0,336,426 and Japanese Patent Provisional Publications No. 2(1990)-20853 and No. 2(1990)-20854 describe that silver halide emulsion having excellent characteristics can be obtained by using hexa-coordinated complex of rhenium, ruthenium, osmium or iridium having at least four cyano ligands. In the emulsions described in these publications, low intensity reciprocity law failure is reduced, and the sensitivity and gradation of the emulsion are stable.

European Patent No. 0,336,427 and Japanese Patent Provisional Publication No. 2(1990)-20852 disclose a silver halide emulsion of a controlled sensitivity. In the emulsion, low intensity reciprocity law failure is reduced by using a hexa-coordinated complex of vanadium, chromium, manganese, iron, ruthenium, osmium, rhenium or iridium having nitrosyl or thionitrosyl ligand.

European Patent No. 0,336,689 and Japanese Patent Provisional Publication No. 2(1990)-20855 also disclose a silver halide emulsion of a controlled sensitivity. In the emulsion, low intensity reciprocity law failure is reduced by hexa-coordinated rhenium complex, which has six ligands selected from halogen, nitrosyl, thionitrosyl, cyan, water and thiocyan.

Japanese Patent Provisional Publication No. 3(1991)-118535 discloses a hexa-coordinated transition metal complex having carbonyl group as one of the ligands. Further, Japanese Patent Provisional Publication No. 3(1991)-118536 discloses an emulsion containing a hexa-coordinated transition metal complex in which two of the ligands are oxygens.

In the above-described publications, it has been considered that the hexa-coordinated transition metal complex doped in the silver,halide crystal be sited at the space of seven vacant lattice points corresponding to a silver atom and six halogen atoms adjoining said silver atom. In contrast, it has been generally presumed that a simple ion or atom of the transition metal be introduced into a silver halide grain.

In all the above-described publications, gelatin is used as protective Colloid when the silver halide grains containing a metal Complex are formed. T. H. James, "The Theory of the Photographic Process" (4th ed., Macmillan, Chapter 2, pp. 71–72) describes an interaction between metal and gelatin. According to the description, noble metals such as gold and platinum or heavy metals such as iridium interact with gelatin to form complex salts or to be reduced. Therefore, in the above-mentioned doping techniques of transition metal complex, unexpected effects (for example, oxidation or reduction of the transition metal, exchanging or decomposition of ligands) have been caused by the interaction between the transition metal complex and gelatin. It has been difficult to control the interaction satisfactorily.

SUMMARY OF THE INVENTION

An object of the present invention is to obtain a full effect of the transition metal complex doping by controlling the doping process so that the interaction between the complex and gelatin should be reduced to the minimum level.

There is provided by the present invention a silver halide photographic material which comprises a support and a silver halide emulsion layer provided thereon, wherein the silver halide emulsion is prepared by nuclear formation, crystal growth and chemical sensitization, all or a part of the nuclear formation or the crystal growth being conducted in the presence of a hexa-coordinated cyano-complex to introduce the complex into crystal lattice of the silver halide, the density of the hexa-coordinated cyano-complex contained in surface parts of silver halide grains being in the range of $10^{-4}$ to $10^{-2}$ mol per 1 mol of silver, said surface parts Of silver halide grains having a thickness of not more than 20Å from the surfaces of the grains, the chemical sensitization being conducted using a gold sensitizer, and the silver halide emulsion being prepared using a synthetic polymer as a protective colloid in place of gelatin which is absent or present in an amount of not more than 10 g per 1 mol of silver.

The applicants have found that the above-mentioned problems of the transition metal doping are not caused by a simple interaction between the complex and gelatin. According to study of the applicants, the problems are caused by a complicated reaction of a cyano-complex, gelatin and a gold sensitizer.

The applicants note that gelatin has a function of decomposing a cyano-complex to form cyanide, which further reacts with a gold sensitizer to form a cyano-complex of gold. The gold sensitizer is usually used in a silver halide emulsion of high sensitivity. If the gold sensitizer is reacted with the cyanide, the sensitivity of the emulsion is greatly reduced because the formed cyano-complex of gold cannot be adsorbed on the surface of silver halide grains. This problem is very serious where a large amount of the hexa-coordinated cyano-complex ($10^{-4}$ to $10^{-2}$ mol per 1 mol of silver) is contained in surface parts of silver halide grains.

According to the present invention, the silver halide emulsion is prepared using a synthetic polymer as a protective colloid in place of gelatin. Therefore, the formation of the cyano-complex of gold is prevented in the preparation of the emulsion.

For the reasons mentioned above, the hexa-coordinated cyano complex ion doped into the silver halide grains can fully improve the photographic properties of the silver halide photographic material of the invention.

DETAILED DESCRIPTION OF THE INVENTION

The hexa-coordinated cyano complex salt used for the invention preferably is a salt containing a hexa-coordinated transition metal complex anion represented by the formula (I):

$$[M(CN)_6]^{n-} \quad (I)$$

wherein M is a metal selected from those consisting of the metals of the fifth, sixth, seventh, eighth, ninth and tenth groups of the fourth, fifth and sixth periods in the periodic table; preferably, M is iron, cobalt, ruthenium, rhenium, rhodium, osmium or iridium; and n is 3 or 4.

Most of the hexa-coordinated metal complex salts dissociate when they are added into aqueous solvents, which are generally used for forming silver halide grains. Therefore, the counter cation is not important. However, ammonium and alkali metal ions are very advantageous for precipitation process of silver halide. Therefore, ammonium and alkali metal ions are particularly preferable as a counter ion of the hexa-coordinated transition metal complex salt.

The hexa-coordinated cyano complex ion is introduced into silver halide crystal. In more detail, the hexa-coordinated cyano complex ion doped in the silver halide crystal is sited at the space of seven vacant lattice points, which corresponds to silver atom and six halogen atoms adjoining the silver atom. In other words, the complex ion replaces seven vacant lattice point ions. A complex ion having negative charge such as the hexa-coordinated cyano complex ion can easily be introduced into the crystal lattice because the total electric charge of these seven vacant lattice point ions is –5. Further, it can also be considered that the ability to capture an electron or a positive hole of the hexa-coordinated transition metal complex depends upon the charge difference between the introduced complex ion and the seven vacant lattice point ions.

The hexa-coordinated cyano complex is spatially similar to the seven vacant lattice point ions. In more detail, the central transition metal ion of the hexa-coordinated cyano complex can be sited at the position of silver atom in silver halide crystal, and the six cyano ions (ligands) of the complex can occupy the positions of the six halogen atoms adjoining the silver atom. It is also understandable that the hexa-coordinated cyano complex is introduced into silver halide crystal and replaces the seven vacant lattice point ions on account of the following facts: a silver ion is much smaller than a bromide ion; silver bromide crystal can involve an iodide ion, which is much larger than a bromide ion; and the distance between a cyano ligand and the central transition metal in the complex is reduced by forming covalent bond to shrink the whole transition metal complex.

The hexa-coordinated cyano complex salt of the invention can be contained in silver halide crystals in the same amount as is used in the conventional transition metal doping. In the conventional doping methods, dopants are used in a variety of amounts. For example, the dopant disclosed in Japanese Patent Provisional Publication No. 51(1976)- 107129 is used in a low concentration ($10^{-10}$ mol per 1 mol of silver). On the other hand, the dopant disclosed in U.S. Pat. Nos. 3,687,676 and 3,690,891 is used in a high concentration ($10^{-3}$ mol per 1 mol of silver). However, the silver halide grains disclosed in U.S. Pat. Nos. 3,687,676 and 3,690,891 have core/shell structures, and the dopant is present in the core parts of the grains.

The appropriate concentration of the complex depends upon halide content of the grain, the used transition metal, oxidation state of the metal and desired photographic effect. The total concentration of the hexa-coordinated cyano complex contained in the grains preferably is $10^{-8}$ to $10^{-2}$ mol per mol of silver.

The amount or the ratio of the hexa-coordinated cyano complex doped in silver halide can be measured by means of atomic absorption analysis of the central transition metal, ICP (inductively coupled plasma spectrometry) analysis and/or ICPMS (inductively coupled plasma mass spectrometry) analysis.

In the present invention, the density of the hexa-coordinated cyano-complex contained in surface parts of silver halide grains being in the range of $10^{-4}$ to $10^{-2}$ mol (preferably $5\times10^{-4}$ to $10^{-2}$ mol) per 1 mol of silver. The surface parts of silver halide grains has a thickness of not more than 20Å from the surfaces of the grains. The surface density (doping ratio) can be measured by immersing silver halide grains in a diluted silver halide solvent to dissolve the surface part of the grains in the solvent, and determining the density of the hexa-coordinated cyano-complex according to the above-mentioned method. Examples of the silver halide solvents include aqueous solutions of sodium thiosulfate, potassium bromide, potassium cyanide or ammonium sulfite.

The hexa-coordinated cyano complex of the invention can be introduced into silver halide crystal by adding the complex while forming silver halide grains. All or a part of the nuclear formation or the crystal growth of the silver halide is carried out in the presence of the complex. Thus, the complex is introduced into the silver halide crystals. A large amount of the complex is preferably doped at the surface or near the surface of the silver halide grain. The hexa-coordinated cyano complex is added to a reaction solution while forming the silver halide grains. The pAg value of the solution preferably is not lower than 6, and more preferably is not lower than 7. The pAg value also preferably is not higher than 10.

The hexa-coordinated cyano complex salt of the invention is preferably dissolved in water or an appropriate solvent to prepare a solution for addition. An aqueous solution of a halide salt of an alkali metal (e.g., KCl, NaCl, KBr, NaBr) can be mixed with the solution to stabilize the complex. An alkali can also be added to the solution, if desired.

The hexa-coordinated cyano complex salt of the invention is preferably added into a reaction solution directly while forming the silver halide is forming. The complex salt can also be added into an aqueous solution of halogen salt or other solutions to be added into the reaction solution for forming the silver halide grains so that the complex may be introduced into the silver halide grains. The other methods for addition of the complex can be used in combination.

The hexa-cyano complex salt can be doped in fine silver halide grains where all or a part of the nuclear formation or crystal growth of silver halide is conducted supplying the silver halide emulsion of the fine silver halide grains. The fine silver halide grains are prepared using a synthetic polymer as a protective colloid, as is described below. Further, the complex can simply be supplied to a reaction container.

When the hexa-coordinated cyano complex salt of the invention is added into a reaction solution, the pH value of the solution preferably is not less than 3. The pH value also preferably is not more than 10.

Two or more hexa-coordinated cyano complex salts can be used in combination. The complex can also be used in combination with other metal ions. Such other metal ions can be used in the form of salts, such as ammonium salt, acetate salt, nitrate salt, sulfate salt, phosphate salt, hydroxide salt, hexa-coordinated complex salt and tetra-coordinate complex salt. The salt should be dissolved in the reaction solution while forming the silver halide grains.

In preparation of the silver halide emulsion, a synthetic polymer is used as a protective colloid.

Examples of the synthetic polymers include polyacrylamide polymer, an amino polymer, a thioether polymer, polyvinyl alcohol, polyacrylic acid, polyacrylic ester, a hydroxyquinoline polymer, a cellulose derivative, a starch derivative, an acetal polymer, polyvinyl pyrrolidone, polystyrene and an imidazole polymer.

Examples of the polyacrylamide include homopolymer of acrylamide; a copolymer of polyacrylamide and imidized polyacrylamide (disclosed in U.S. Pat. No. 2,541,474); a copolymer of acrylamide and methacrylamide (disclosed in West Germany Patent No. 1,202,132); partially aminized acrylamide polymer disclosed in U.S. Pat. No. 3,284,207); and a substituted acrylamide polymer (disclosed in Japanese Patent Publication No. 45(1970)-14031, U.S. Pat. Nos. 3,713,834 and 3,746,548 and U.K. Patent No. 788,343).

The amino polymers are disclosed in U.S. Pat. Nos. 3,345,346, 3,706,504, 4,350,759 and West German Patent No. 2,138,872. Examples of the amino polymers further include a polymer having quaternary amine (disclosed in U.K. Patents No. 1,413,125 and U.S. Pat. No. 3,425,836); a polymer having amino group and carboxyl group (disclosed in U.S. Pat. No. 3,511,818); and a polymer disclosed in U.S. Pat. No. 3,832,185.

The thioether polymer is disclosed in U.S. Pat. Nos. 3,615,624, 3,860,428 and 3,706,564.

Examples of polyvinyl alcohol include homopolymer of vinyl alcohol; monoester of organic acid and polyvinyl alcohol (disclosed in U.S. Pat. No. 3,000,741); maleic acid ester (disclosed in U.S. Pat. No. 3,236,653); and a copolymer of polyvinyl alcohol and polyvinyl pyrrolidone (disclosed in U.S. Pat. No. 3,479,189).

Examples of the polyacrylic acid and the polyacrylic ester include homopolymer of acrylic acid; an acrylate polymer having amino group (disclosed in U.S. Pat. Nos. 3,832,185 and 3,852,073); a halogen-substituted acrylate polymer (disclosed in U.S. Pat. No. 4,131,471); and a cyanoalkyl acrylate (disclosed in U.S. Pat. No. 4,120,727).

The hydroxyquinoline polymer is disclosed in U.S. Pat. Nos. 4,030,929 and 4,152,161.

The derivatives of cellulose and starch are disclosed in U.K. Patents No. 542,704 and No. 551,659 and U.S. Pat. Nos. 2,127,573 and 2,322,085.

An example of the acetal polymer is polyvinyl acetal (disclosed in U.S. Pat. Nos. 2,358,836, 3,003,879 and 2,828,204 and U.K. Patent No. 711,155).

Examples of the polyvinyl pyrrolidone include homopolymer of polyvinyl pyrrolidone; and a copolymer of acrolein and pyrrolidone (disclosed in French Patent No. 2,031,396).

Examples of the polystyrene include a polystyrylamine polymer (disclosed in U.S. Pat. No. 4,315,071); and a halogen-substituted styrene polymer (disclosed in U.S. Pat. No. 3,861,918).

Examples of the imidazole polymer include a polymer having vinylimidazole group (disclosed in Japanese Patent Publications No. 43(1968)-7561, No. 47(1972)-25374 and No. 52(1977)-16365 and German Patents No. 2,012,095 and No. 2,012,970).

Examples of the other synthetic colloidal polymers include vinyl polymers having azaindene group (disclosed in Japanese Patents Provisional Publication No. 59(1984)-8604); polyalkyleneoxide derivative (disclosed in U.S. Pat. No. 2,976,150); polyvinylamineimide polymer (disclosed in U.S. Pat. No. 4,022,623); polymer disclosed in U.S. Pat. Nos. 4,294,920 and 4,089,688; polyvinylpyridine (disclosed in U.S. Pat. No. 2,484,456); vinyl polymer having imidazole group (disclosed in U.S. Pat. No. 3,520,857); vinyl polymer having triazole group (disclosed in Japanese Patent Publication No. 60(1985)-658); polyvinyl-2-methylimidazole and copolymer of acrylamide and imidazole (described in "NIHON SHASHIN GAKKAI-SHI" vol. 29, No. 1, pp. 18); and water-soluble polyalkyleneaminotriazole (described in Zeitschrift wissenschaftlich Photographie, vol. 45, 1950, pp. 43).

The amount of the synthetic polymer used as the protective colloid preferably is not more than 150 g, more preferably is not more than 80 g, and most preferably is not more than 20 g per 1 mol of silver halide. The amount also preferably is not less than 0.1 g per 1 mol of silver halide.

In the present invention, the silver halide emulsion is prepared using the synthetic polymer as a protective colloid. Even though gelatin is used, the amount of gelatin is not more than 10 g per 1 mol of silver. Most preferably, no gelatin is used in the process.

After the preparation of silver halide emulsion is completed (in more detail, after the chemical sensitization is completed), however, gelatin is preferably added as a vehicle (binder) in an amount of at least 30 g, and more preferably at least 50 g per 1 mol of silver. Gelatin is added to the emulsion before the emulsion is coated on a support. Examples of the vehicles including gelatin are described in Research Disclosure vol. 176, item 17643.

The temperature of the solution in forming the silver halide grains preferably is in the range of 10° to 95° C., and more preferably is in the range of 40° to 80° C.

In the present invention, all or a part of the nuclear formation or the crystal growth of the silver halide grains is preferably conducted with supplying silver halide emulsion containing fine silver halide grains. The grains are prepared using a synthetic polymer as a protective colloid. The processes using fine silver halide grains are described in Japanese Patent Provisional Publications No. 1(1989)-183417, No. 1(1989)-183644, No. 1(1989)-183645, No. 2(1990)-43534, No. 2(1990)-43535 and No. 2(1990)-44335, U.S. Pat. No. 4,879,208 and European Patent No. 0,408,752.

The concentration of the synthetic polymer in the emulsion of the fine silver halide grains preferably is not more than 20 wt. %, more preferably is not more than 10 wt. %, and most preferably is not more than 5 wt. %. The concentration also preferably is not less than 0.01 wt. %.

The amount of the synthetic polymer contained in a reaction solution to which silver halide emulsion containing fine silver halide grains is supplied preferably is not more than 150 g, more preferably is not more than 80 g, and most preferably is not more than 20 g per 1 mol of silver halide. The amount also preferably is not less than 0.1 g. In the supplying process, preferably no gelatin is used. Even though gelatin is used, the amount of gelatin contained in the solution is not more than 10 g per 1 mol of silver.

The temperature of the solution in forming the grains preferably is within the range of 10° to 95° C., and more preferably is within the range of 40° to 80° C. The temperature in forming the fine silver halide grains is not more than 40° C., preferably not more than 35° C.

The size of the fine silver halide grains can be measured by observing the grains placed on a measuring mesh with a transmission electron microscope. The magnifying power in the observation is preferably within the range of 20,000 to 40,000. The size of the fine silver halide grain preferably is not more than 0.06 μm, more preferably is not more than 0.03 μm, and most preferably is not more than 0.01 μm.

Examples of the silver halide used in the present invention include silver chloride, silver bromide, silver chlorobromide, silver chloroiodide, silver iodobromide and silver chloroiodobromide. The size of the silver halide grains of the invention preferably is within the range of 0.05 to 10 μm, and more preferably is within the range of 0.1 to 3 μm. The size of the grains can be controlled by adjusting the conditions such as the reaction temperature, the pAg value of the reaction solution, the nature and amount of the solvent, and the rate of adding a halogen salt and a silver salt used in the crystal growth.

In preparation of the silver halide emulsion, a silver halide solvent is sometimes used. Examples of the solvents include thiocyanates, thioethers, thioureas, thiones and amines. Ammonia is also available in combination with the other solvent, as long as it does not give an unfavorable effect. The thiocyanates are disclosed in U.S. Pat. Nos. 2,222,264, 2,448,534 and 3,320,069. The thioether compounds are disclosed in U.S. Pat. Nos. 3,271,157, 3,574,628, 3,704,130, 4,297,439 and 4,276,347. The thiones are disclosed in Japanese Patent Provisional Publications No. 53i(1978)-144319, No. 53(1978)-82408 and No. 55(1980)-77737. The amines are disclosed in Japanese Patent Provisional Publication No. 54(1979)-100717.

The silver halide grains may be of various crystal forms. Examples of the forms include a regular crystal form (normal crystal grain), an irregular form, and other forms having one or more twinning planes. The regular crystal forms include hexahedron, octahedron, dodecahedron, tetradecahedron, tetracosahedron and octatetracontahedron. The irregular forms include spherical form and potato-like form. Examples of the other forms include hexagonal tabular grain and triangular tabular twin grain each of which has two or three parallel twinning planes.

The silver halide emulsion can be prepared by any of known methods. An aqueous solution of a silver salt is usually mixed with an aqueous solution of a halogen salt in a reaction container containing an aqueous solution of gelatin while effectively stirring. The processes for preparation of the emulsion are described in "Chemie et Phisique Photographique (Paul Montel, 1970)" written by P. Glafkides, "Photographic Emulsion Chemistry (The Focal Press, 1966)" written by G. F. Duffin, and "Making and Coating Photographic Emulsion," (The Focal Press, 1964) written by V. L. Zelikman et al. Any of the acid method, the neutral method and the ammonia method is available for preparation of the emulsion. Further, one-side mixing method, simultaneous mixing method and the combination thereof are available for a reaction of a soluble silver salt with a soluble halogen salt.

A controlled double jet process (a kind of the simultaneous mixing method) is also available. In the controlled double jet process, the pAg value of the reaction solution (in which silver halide is formed) is controlled at a constant value. Preferably, the silver halide grains are quickly grown an condition that the concentration of the reaction solution is controlled under the critical supersaturation. For such crystal growth, the rates of adding silver nitrate and alkaline halide can be varied according to the rate of crystal growth, as is disclosed in U.K. Patent No. 1,535,016, Japanese Patent Publications No, 43(1968)-36890 and No. 52(1977)-16364. The concentration of the aqueous solution can also be controlled as is disclosed in U.S. Pat. No. 4,242,445 and Japanese Patent Provisional Publication No. 55(1980)-158124. These processes are preferably used because renucleation of the silver halide does not occur and the grains are homogeneously grown.

The gains in the emulsion may have various structures. Examples of the structures include so-called core/shell double-layered structure (which consists of the core and the shell), triple-layered structure (disclosed in Japanese Patent Provisional Publication No. 60(1985)-222844) and multilayered structure consisting of more than three layers. In addition to the layered structures, the grains may have a fused structure, which is disclosed in Japanese Patent Provisional Publications No. 59(1984)-133540, No. 58(1983)-108526 and No. 59(1984)-16254, European Patent No. 199,290 A2, and Japanese Patent Publication No. 58(1983)-24772.

To form a crystal of the fused structure, crystals having the composition different from that of the host crystals (i.e., the guest crystals) are fused at the edge, the corner or the face of the host crystal. Such fused crystals can be prepared whether the host crystal has homogeneous halogen composition or not. For example, even if the host crystal has a core/shell type structure, the fused crystals can be further formed.

The fused crystals may consist of a combination of a silver halide and a silver salt which does not have the rock salt structure (e.g., silver rhodanate, silver carbonate) as well as a combination of silver halides. Further, non-silver salts (e.g., PbO) are also available if the fused crystals can be formed.

For example, silver iodobromide grain of core/shell type may contain such iodide distribution that silver iodide content in the core is higher than that in the shell. Further, the grain may have such a structure that silver iodide content in the shell is higher than that in the core. In the case of silver iodobromide grains of fused crystals, the silver iodide content in the host crystals may be higher than that in the guest crystal. The content in the guest crystal may also be higher than that in the host crystal. In the above-described grains consisting of two or more portions in which compositions of silver halide are different each other, the portions can be distinguished by a clear border. The border can also be vague. Mixed crystals of adjoining parts have such a vague border. Further, the composition may be gradually changed between the portions.

The silver halide emulsion may be so treated that the grains be rounded, as is described in European Patents No. 0,096,727 B1 and No. 0,064,412 B1. Further, the surface of the grains can be modified, as is described in DE-2,306,447 C2 and Japanese Patent Provisional Publication No. 60(1085)-221320.

A silver halide emulsion of surface latent image type is preferred. An emulsion of internal latent image type is also available, if developers and developing conditions are appropriately selected (as is described in Japanese Patent Provisional Publication No. 59(1084)-133542). Further, an emulsion of shallows-internal latent image type (such emulsion contains the grains covered with thin shell) is optionally usable.

The silver halide grains preferably have a dislocation line. The grain having such a dislocation line is disclosed in U.S. Pat. No. 4,806,461.

The silver halide emulsion is generally subjected to a spectral sensitization. Examples of spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Cyanine dyes, merocyanine dyes and complex merocyanine dyes are particularly preferred. The dyes may have a basic heterocyclic ring, which is usually contained in the cyanine dyes. Examples of the heterocyclic rings include pyrroline ring, oxazoline ring, thiazoline ring, selenazoline ring, pyrrole ring, oxazole ring, thiazole ring, selenazole ring, imidazole ring, tetrazole ring, pyridine ring and tellurazole ring. The heterocyclic ring may be condensed with an alicyclic hydrocarbon ring or an aromatic hydrocarbon ring. Examples of the condensed rings include indolenine ring, benzindolenine ring, indole ring, benzoxazole ring, naphtooxazole ring, benzimidazole ring, naphthoimidazole ring, benzothiazole ring, naphthothiazole ring, benzoselenazole ring, naphthoselenzole ring, quinoline ring and benzotellurazole ring. The heterocyclic ring of the dye may have a substituent group on its carbon atom.

Merocyanine dyes and complex merocyanine dyes may contain a ring having a ketomethylene structure, which is usually contained in merocyanine dyes. The rings of the ketomethylene structure preferably are 5- or 6-membered heterocyclic rings such as pyrazoline-5-one ring, thiohydantoin ring, 2-thiooxazolidine-2,4-dione ring, thiazolidine-2,4-dione ring, rhodanine ring, thiobarbituric acid ring and 2thioselenazolidine- 2,4-dione.

Two or more sensitizing dyes can be used in combination. The combination of the sensitizing dyes is often used for supersensitization. Examples of the combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862 and 4,026,707; U.K. Patents No. 1,344,281 and No. 1,507,803; Japanese Patent Publications No. 43(1968)-4936 and No. 53(1978)-12375; and Japanese Patent Provisional Publications No. 52(1977)-110618 and No. 52(1977)-109925.

The sensitizing dye may be also used in combination with a supersensitizer, which themselves cannot spectrally sensitize the emulsions or cannot absorb visible light. The supersensitizer enhances the effect of spectral sensitization in combination with a sensitizing dye. Examples of the supersensitizers include bispyridinium salt compounds (disclosed in Japanese Patent Provisional Publication No. 59(1984)-142541), stilbene derivatives (disclosed in Japanese Patent Publication No. 59(1984)-18691), water-soluble bromide and iodide such as potassium bromide and potassium iodide (disclosed in Japanese Patent Publication No. 49(1974)-46932), condensed compounds of aromatic compounds and formaldehydes (described in U.S. Pat. No. 3,743,510), cadmium salts and azaindene compounds. The sensitizing dye is added to the emulsion on or before chemical sensitization. In the present invention, the sensitizing dyes are preferably used before chemical sensitization (e.g., at the stage of forming grains or physical ripening).

The silver halide emulsion is chemically sensitized. Examples of the chemical sensitizations include halcogen sensitizations (e.g., sulfur sensitization, selenium sensitization and tellurium sensitization), noble metal sensitizations (e.g., gold sensitization) and reduction sensitizations. In the present invention, a gold sensitizer is used singly or in combination with the other sensitizers.

The gold sensitizer usually is a salt of gold. The gold sensitizers are disclosed in "Chemie et Phisique Photographique (Paul Montel, 1970)" written by P. Glafkides and Research Disclosure, vol. 307, No. 307105. Examples of the gold sensitizers include chloroauric acid, potassium chloroaurate, potassium aurithiocyanate, gold sufide, gold selenide and gold compounds, which are described in U.S. Pat. Nos. 2,642,361, 5,049,484 and 5,049,485.

The other noble metal sensitizers, such as salts of platinum, palladium and iridium can be used in combination with the gold sensitizer. The amount of the gold sensitizer (and the other noble metal sensitizers) is preferably $10^{-7}$ to $10^{-2}$ mol per 1 mol of silver.

Sulfur sensitization is carried out using a labile sulfur compound as a sulfur sensitizer. The labile sulfur compounds are well known and disclosed in "Chemie et Phisique Photographique (Paul Montel, 1970)" written by P. Glafkides and Research Disclosure, vol. 307, No. 307105. Examples of sulfur sensitizers include thiosulfates (e.g., sodium thiosulfate), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethylrhodanine, 5-benzylidene-N-ethyl-rhodanine), phosphinesulfides (e.g., trimethylphosphinesulfide), thiohydantoins, 4-oxo-oxazolidine- 2-thiones, disulfides or polysulfides (e.g., dimorpholinedisulfide, cystine, hexathiocane-thione), mercapto compounds (e.g., cysteine), polythionic acid salts, simple body of sulfur and active gelatin.

Selenium sensitization is carried out using a labile selenium compound as a selenium sensitizer. The labile selenium compounds are disclosed in Japanese Patent Publications No. 43(1968)-13489 and No. 44(1969)-15748, Japanese Patent Provisional Publications No. 4(1992)-25832 and No. 4(1992)-109240 and Japanese Patent Applications No. 3(1991)-53693 and NO. 3(1991)-82929. Examples of the selenium sensitizers include colloidal metal selenium, selenoureas (e.g., N,N-dimethylselenourea, trifluoromethylcarbonyl-trimethylselenourea and acetyl-trimethylselenourea), selenoamides (e.g.,selenoacetamide, N,N-diethylphenylselenoamide), phosphineselenides (e.g., triphenylphosphineselenide and pentafluorophenylphosphineselenide), selenophosphates (e.g., tri-p-tolylselenophosphate, tri-n-butylselenophosphate), selenoketones (e.g., selenobenzophenone), isoselenocyanates, selenocarboxylic acids, selenoesters and diacylselenides. Selenium compounds disclosed in Japanese Patent Publications No. 46(1971)-4553 and No. 52(1977)- 34492 are also available, though they are not labile compounds. Examples of the relatively stable selenium compounds include selenious acid, potassium selenocyanate, selenazoles and selenides.

Tellurium sensitization is carried out using a labile tellurium compound as a tellurium sensitizer. The labile tellurium compounds are disclosed in Canadian Patent No. 800,958, U.K. Patents No. 1,295,462 and No. 1,396,696, and Japanese Patent Applications No. 2(1990)-333819, No. 3(1991)-53693, No. 3(1991)-131593 and No. 4(1992)-129787. Examples of the tellurium sensitizers include telluroureas (e.g., tetramethyltellurourea, N,N'-dimethylethylenetellurourea and N,N'-diphenylethylenetellurourea), phosphinetellurides (e.g., butyldiisopropylphosphinetelluride, tributylphosphinetelluride, tributoxyphosphinetelluride and ethoxydiphenylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, and bis(ethoxycarbonyl)telluride), isotellurocyanates, telluroamides, tellurohydrazides, telluroesters (e.g., butylhexyltelluroester), telluroketones (e.g., telluroacetophenone), colloidal metal tellurium, (di)tellurides, and other tellurium compounds (e.g., potassium telluride, sodium telluropentathionate).

Reduction sensitization is carried out using known reducing compounds, which are disclosed in "Chemie et Phisique Photographique (Paul Montel, 1970)" written by P. Glafkides and Research Disclosure, vol. 307, No. 307105. Examples of the reducing compounds include aminoiminomethanesulfinic acid (i.e., thiourea dioxide), borane compounds (e.g., dimethylaminoborane), hydrazine compounds (e.g., hydrazine and p-tolylhydrazine), polyamine compounds (e.g., diethylenetriamine and triethylenetetramine), tin(IF) chloride, silane compounds, reductones (e.g., ascorbic acid), sulfites, aldehydes and hydrogen gas. Reduction sensitizatien can also be carried out under condition of a high pH or condition of silver excess. The reduction sensitizaticn under the silver excess condition is called "silver ripening."

Two or more chemical sensitizations can be carried out in combination with the gold sensitization. A combination of a chalcogen sensitization with the gold sensitization is particularly preferred. The reduction sensitization is preferably carried cut while forming silver halide grains.

The amount of the chalcogen sensitizer used for the invention depends on the silver halide grains and the conditions of chemical sensitization. The chalcogen sensitizer is preferably used in an amount of $10^{-8}$ to $10^{-2}$ mol, and more preferably used in an amount of $10^{-7}$ to $5\times10^{-3}$ mol per 1 mol of silver.

With respect to the condition of chemical sensitization, the pAg value is preferably in the range of 6 to 11, and more preferably in the range of 7 to 10. The pH value is preferably in the range of 4 to 10. The temperature is preferably in the range of 40° to 95° C., and more preferably in the range of 45° to 85° C.

The photographic emulsion may contain various additives such as stabilizer and anti-fogging agent to stabilize the photographic properties of the photographic material or to inhibit the fog at the processes for preparing, storing or treating the photographic material. Examples of the additives include azoles such as benzothiazolium salts, nitroindazoles, triazoles, benzotriazoles and benzimidazoles (nitro-substituted or halogen substituted benzimidazoles is particularly preferred); heterocyclic mercapto compounds such as mercaptothiazoles, mercaptobenzothiazoles, mercaptobenzidazoles, mercaptothiadiazoles, mercaptotetrazoles (1-phenyl-5-mercaptotetrazole is particularly preferred) and mercaptopyrimidines; the compound synthesized by adding water-soluble group such as carboxyl group and sulfo group to the above-mentioned heterocyclic mercapto compounds; thioketo compounds such as oxazolinethione; azaindenes such as tetraazaindenes (4-hydroxy substituted (1,3,3a,7)-tetraazaindenes are particularly preferred); benzenethiosulfonic acids; and benzenethiosulfinic acids.

The above-mentioned stabilizers and anti-fogging agents are added usually after a chemical sensitizer is added to a silver halide emulsion. They are more preferably added to the emulsion while or before chemically ripening the emulsion.

The silver halide emulsion can be used for a photographic material having any number of emulsion layers. For example, the emulsion can be used for a multi-layered color photographic material, which comprises three or more emulsion layers to record images of green, blue and red light on each layer independently. Each of the emulsion layers contains a binder and silver halide grains. The layer may comprise at least two sub-layers (e.g., a low sensitive sub-layer and a high isensitive sub-layer).

In addition to the color photosensitive material described above, the silver halide emulsion is also available for other photographic materials independently of the number of the emulsionlayers. Examples of the photographic materials include a X-ray photographic material, a black and white photographic material, a photographic presensitized plate and a photographic paper.

In the present invention, there is no specific limitation with respect to the other additives, the support and the coating, exposing and developing processes. Examples of the additives include a binder, a chemical sensitizer, a spectral sensitizers, a stabilizer, a gelatin hardening agent, a surface active agent, an antistatic agent, a polymer latex, a matting agent, a color coupler, a UV absorber, a discoloration inhibitor and a dye. The details are described in Research Disclosure, vol. 176, item 17643 (RD-17643); ibid., vol. 187, item 18716 (RD-18716); and ibid., vol. 225, item 22534 ! (RD-22534).

The descriptions in the Research Disclosure are shown below.

| Additives | RD-17643 | RD-18716 | RD-22534 |
|---|---|---|---|
| 1. Chemical sensitizer | pp. 23 | pp. 648 (right side) | pp. 24 |
| 2. Sensitivity -increasing agent | | pp. 648 (right side) | |
| 3. Spectral sensitizer Supersensitizer | PP. 23–24 | pp. 648– (right side) pp. 649 (right side) | pp. 24–28 |
| 4. Whitening agent | pp. 24 | | |
| 5. Anti-fogging agent & stabilizer | pp. 24–25 | pp. 649– (right side) | pp. 24, 31 |
| 6. Light-absorber, Filter dye & UV absorber | pp. 25–26 | pp. 649– (right side) pp. 650 (left side) | |
| 7. Anti-stain agent | pp. 25 (right side) | pp. 650 (left– right side) | |
| 8. Color-image stabilizer | pp. 25 | | pp. 32 |
| 9. Hardening agent | pp. 26 | pp. 651 (left side) | pp. 28 |
| 10. Binder | pp. 26 | pp. 651 (left side) | |
| 11. Plasticizer & Slipping agent | pp. 27 | pp. 650 (right side) | |
| 12. Coating aid & Surface active agent | pp. 26–27 | pp. 650 (right side) | |
| 13. Antistatic agent | pp. 27 | pp. 650 (right side) | |
| 14. Color coupler | pp. 25 | pp. 649 | pp. 31 |

The color couplers used for the invention are preferably nondiffusing compounds. In more detail, the couplers preferably have ballast groups or are in the form of polymers. Two equivalent couplers having coupling elimination groups at the coupling active positions are more preferred to four equivalent couplers having hydrogen atoms at the coupling active positions. The amount of silver used with the former coupler can be smaller than that used with the latter. The other various couplers are also available. Examples of the other couplers include couplers forming a moderately diffusible dye, colorless couplers, DIR couplers (which release development inhibitor during the coupling reaction) and couplers releasing development accelerator.

Examples of the yellow couplers are acylamide couplers of an oil protective type (e.g., yellow couplers of oxygen atom eliminating type or of nitrogen atom eliminating type). Particularly, α-pivaloylacetanilide coupler and α-benzoylacetanilide coupler are preferred, since the former forms a dye which a particularly stable to light and the latter forms a color image of high density.

Examples of the magenta couplers are oil protected couplers, such as indazolone couplers, cyanoacetyl couplers 5-pyrazolone couplers and pyrazoloazole couplers. Particularly, 5-pyrazolone couplers and pyrazoloazole couplers (e.g., pyrazolotriazoles) are preferred. Preferably, 5-pyrazolone couplers are substituted with an arylamino group or an acylamino group at 3-position to improve the hue of the developed dye and the density of the color.

The undesired absorption of the magenta coupler within the yellow range preferably is small, and the formed dye preferably is stable to light. Accordingly, imidazo[1,2-b] pyrazoles described in U.S. Pat. No. 4,500,630 are preferred, and pyrazolo[1,5-b][1,2,4]triazoles described in U.S. Pat. No. 4,540,654 are particularly preferred.

Examples of the cyan coupler include phenol cyan couplers and naphthol cyan couplers of oil protective type. Naphthol cyan couplers are described in U.S. Pat. No. 2,474,293. Two equivalent naphthol couplers of oxygen atom eliminating type (which are particularly preferred) are described in U.S. Pat. Nos. 4,052,212, 4,146,396, 4,228,233 and 4,296,200.

The cyan couplers having an amido or sulfonamido group at 5-position of naphthol are also preferred because they give a stable color image. These couplers are described in Japanese Patent Application No. 59(1984)-93605, No. 59(1984)-264277 and No. 59(1984)-268135.

The couplers forming moderately diffusible dyes can improve the graininess of the image. Such couplers are described in U.S. Pat. No. 4,366,237 and U.K. Patent No. 2,125,570 (magenta doupler); and European Patent No. 96,570 and West German Patent No. 3,234,533 (yellow, magenta or cyan coupler).

DIR couplers maybe used in the photographic material of the present invention. The DIR couplers release a development inhibitor by a coupling reaction. Examples of DIR couplers include the couplers of developer deactivation type (described in Japanese Patent Provisional Publication No. 57(1982)-151944); those of timing type (described in U.S. Pat. No. 4,248,962 and Japanese Patent Provisional Publication No. 57(1982)-154234); and those of reaction type (described in Japanese Patent Application No. 59(1984)-39653). The DIR couplers of developer deactivation type are particularly preferred. The developer deactivation type couplers are further described in Japanese Patent Provisional Publications No. 57(1982)-151944 and No. 58(1983)-217932, Japanese Patent Applications No. 59(1984)- 75474, No. 59(1984-82214 and No. 59(1984)-90438. The DIR couplers of reaction type are further described in Japanese Patent Application No. 59(1984)-39653.

Development accelerators are also available in the present invention. The accelerators include a nucleation accelerator, a development accelerator and precursors thereof. A typical example of such coupler is a DAR coupler, which releases development accelerator by a coupling reaction of an oxidized developer with an aromatic primary amine. The DAR coupler is described in U.K. Patents No. 2,097,140 and No. 2,131,188.

Organic solvents having a high boiling point are used for dispersing the color coupler in the emulsion. Examples of the solvent include phthalates (e.g., dibutyl phthalate, dicyclohexyl phthalate, di-2-ethylhexyl phthalate, decyl phthalate), phosphates or phosphonates (e.g., triphenyl phosphates, tricresyl phosphate, 2-ethylhexyldiphenyl phosphate, tricyclohexylphosphate, tri-2-ethylhexyl phosphate, tridodecyl phosphate, tributoxyethyl phosphate, trichloropropyl phosphate, di-2-ethylhexylphenyl phosphate), benzoates (e.g., 2-ethylhexyl benzoate, dodecyl benzoate, 2 -ethylhexyl-p-hydroxy benzoate), amides (diethyldodecaneamide, N-tetradodecylpyrrolidone), alcohols or phenols (e.g., isostearyl alcohol, 2,4-di-tert-amylphenol), aliphatic carboxylic acid esters (e.g., dioctyl azelate, glycerol tributylate, isostearyl lactate, trioctyl citrate), aniline derivatives (e.g., N,N-dibutyl-2-butoxy-5 -tert-octylaniline), and hydrocarbons (e.g., paraffin, dodecylbenzene, diisopropylnaphthalene). An auxiliary solvent is also available. The auxiliary solvent preferably is an organic solvent having a boiling point of not more than 30° C., and more preferably in the range of 50° to 160° C. Examples of the auxiliary solvents include ethyl acetate, butyl acetate, ethyl propionate, methyl ethyl ketone, cyclohexanone, 2-ethoxyethyl acetate and dimethylformamide.

The hardening agents rapidly harden a hydrophilic colloid such as gelatin to stabilize the photographic properties. Examples of the hardening agent include active halogen compounds (e.g., 2,4-dichloro-6-hydroxy-1,3,5-triazine and its sodium salt); active vinyl compounds (e.g., 1,3 -bisvinylsulfonyl-2-propanol, 1,2-bis(vinylsulfonylacetamide)ethane, vinyl polymer having vinylsulfonyl group connecting to the side chain); N-carbamoylpyridinium salts (e.g., 1-morpholinocarbonyl-3-pyridinio)methanesulfonate); and haloamidinium salts (e.g., 1-(1-chloro-1-pyridinomethylene)pyrrolidinium-2-naphthalenesulfonate). Active halogen compounds and active vinyl compounds are preferred, because they remarkably stabilize the photographic properties.

A color photographic material is usually treated with a color development, a bleach-fix or fix process and then a washing or stabilizing process.

The washing process is generally carried out according to a countercurrent replenishing method using two or more washing tanks. The stabilizing process can be carried out instead of washing. A typical example of the stabilizing process is a multistage countercurrent stabilizing treatment, which is described in Japanese Patent Provisional Publication No. 57(1982)-8543.

A color developing solution preferably is an alkaline solution which mainly contains an aromatic primary amine color developing agent. Aminophenols and p-phenylenediamines are available as the color developing agent. P-phenylenediamines are particularly preferred. Examples of the developing agent include 3-methyl-4-amino-N,N-diethylaniline, 3-methyl-4,amino-N-ethyl-N-β-hydroxyethylaniline, 3-methyl-4-amino-N-ethyl-N-β-methanesulfonamidoethylaniline and 3-ethyl-4-amino-N-ethyl-N-β-methoxyethylaniline. Sulfate, hydrochloride and p-toluenesulfonate of these compounds are also available. Two or more compounds can be used in combination.

In a reversal development, a black and white development is usually followed by a color development. The developing solution for the black and white development contains a black and white developing agent, which is well known. Examples of the black and white developing agents include dihydroxybenzenes (e.g., hydroquinone), 3-pyrazolidones (e.g., 1-phenyl-3-pyrazolidone) and aminophenols (e.g., N-methyl-p-aminophenol). Two or more agents can be used in combination.

The pH value of the color developing solution or the black and white developing solution is generally in the range of 9 to 12. The replenishing amount of the developing solution is usually not more than 3 l per 1 $m^2$ of the color photosensitive material. The replenishing amount can be reduced to not more than 500 ml by reducing the concentration of bromide ion in the replenishing solution.

After the color development, the photographic emulsion layer is usually bleached. The bleach can be conducted together with the fix (or bleach-fix) process. The bleach and fix process can separately be conducted. Further, the bleach process can be followed by the bleach-fix process for rapid development. Iron(III) complexes of aminopolycarboxylic acids may be contained in bleaching bath or bleach-fix bath. The pH value in the bleaching or bleach-fix bath using the iron(III) complexes of aminopolycarboxylic acids is usually in the range of 5.5 to 8. The pH value can be further lowered for the rapid processing.

A bleaching accelerator can be used in the bleaching bath, the bleach-fix bath or the prebath thereof. Examples of the bleaching accelerator include compounds having a mercapto group or a disulfide group, which are preferred because of their strong effects. The compounds described in U.S. Pat. No. 3,893,858, German Patent No. 1,290,812 and Japanese Patent Provisional Publication No. 53(1978)- 95630 are particularly preferred. The compounds described in U.S. Pat. No. 4,552,834 are also preferred. The above-mentioned bleaching accelerator can also be added to the photographic material.

In the process of the silver halide color photographic material, the washing process or the stabilization process is conducted after the desilvering process. The amount of water in the washing process is determined according to the nature of the photographic material (e.g., the nature of the components such as coupler), use of the material, temperature of washing water, the number of washing tanks (used in the washing process), the replenishing method (countercurrent or not), and the other conditions. The relation between the number of washing tanks and the amount of water in a multistage countercurrent method is described in Journal of the Society of Motion Picture and Television Engineers, vol. 64, p. 248-253 (May 1955).

EXAMPLE 1

Emulsion A-1: octahedral silver bromide emulsion prepared using gelatin (Comparison Example)

In 866 cc of water were dissolved 0.25 g of potassium bromide and 36 g of gelatin. To the mixture, 36 cc of 0.083M(mol/l) silver nitrate aqueous solution (Solution 1) and 36 cc of 0.088M(mol/l) potassium bromide aqueous solution (Solution 2) were added while stirring at 75° C. Then, 176 cc of Solution 1 and Solution 2 were further added to the mixture according to the normal double-jet method for 7 minutes. After 1.4 g of potassium bromide was further added to the obtained solution, 1010 cc of 0.082M silver nitrate aqueous solution (Solution 3) was added with increasing the adding rate from 1.8 cc/minute for 78 minutes. During this addition of Solution 3, 0.90M potassium bromide aqueous solution (Solution 4) was added at the same time so that the electric potential of silver might be kept at 0 mV (vs. saturated calomel electrode). Then, 578 cc of 0.51M silver nitrate aqueous solution (Solution 5) and 578 cc of 0.51M potassium bromide aqueous solution (Solution 6) were added at the constant rate for 24 minutes. After that, the resulting solution was cooled to 35° C., and then water-soluble salts were removed according to a conventional precipitation method. The obtained solution was heated to 40° C. and gelatin was further added. The pH value of the obtained solution was adjusted to 6.3. Thus, prepared was a silver halide emulsion (an octahedral silver bromide-monodispersed emulsion, fluctuation coefficient: 10 and the mean diameter of the circle corresponding to the projected area is 0.8 μm).

Emulsion B-1: octahedral silver bromide emulsion prepared using a synthetic polymer as a protective colloid (Comparison Example)

The procedure of the above-mentioned preparation of Emulsion A-1 was repeated except for using 2 g of the synthetic polymer represented by the following (1) instead of gelatin.

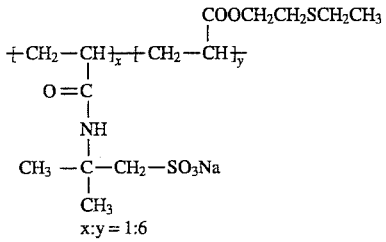

(1)

In the procedure, water-soluble salts were spontaneously precipitated and washed three times by decantation to be removed, and then the pH value of the obtained solution was adjusted to 6.3. Thus, prepared was a silver halide emulsion (anioctahedral silver bromide-monodispersed emulsion, fluctuation coefficient: 10%, and the mean diameter of the circle corresponding to the projected area is 0.8 μm).

Emulsions A-2, A-3, A-4 and A-5: hexa-coordinated cyano-complex doped octahedral silver bromide emulsion prepared using gelatin (Comparison Example)

The procedure of the preparation of Emulsion A-1 was repeated except that $5\times10^{-4}$ M of each of the following (2), (3), (4) and (5) was dissolved in Solution 6 to prepare each of Emulsions A+2, A-3, A-4 and A-5, respectively.

$K_4[Fe(CN)_6]$ (2)

$K_3[Fe(CN)_6]$ (3)

$K_4[Ru(CN)_6]$ (4)

$K_3[Ir(CN)_6]$ (5)

Emulsion A-6: hexa-coordinated cyano-complex slightly doped octahedral silver bromide emulsion prepared using gelatin (Comparison Example)

The procedure of the preparation of Emulsion A-1 was repeated except that $1\times10^{-5}$ M of the above (2) was dissolved in Solution 6 to prepare Emulsion A-6.

Emulsions B-2, B-3, B-4 and B-5: hexa-coordinated cyano-complex doped octahedral silver bromide emulsion prepared using a Synthetic polymer as a protective colloid (Example)

The procedure of the preparation of Emulsion B-1 was repeated except that $5\times10^{-4}$ M of each of the above (2), (3), (4) and (5) was dissolved in Solution 6 to prepare each of Emulsions B-2, B-3, B-4 and B-5, respectively.

Emulsion B-6: hexa-coordinated cyano-complex slightly doped octahedral silver bromide emulsion prepared using a synthetic polymer as a protective colloid (Comparison Example)

The procedure of the preparation of Emulsion B-1 was repeated except that $1\times10^{-5}$ M of the above (2) was dissolved in Solution 6 to prepare Emulsion B-6.

Each of Emulsions A-1, B-1, A-2, A-3, A-4, A-5, A-6, B-2, B-3, B-4, B-5 and B-6 was subject to chemical sensitization using $1.2\times10^{-5}$ mol/mol Ag of sodium thiosulfate, $3.6\times10^{-6}$ mol/mol Ag of potassium chloroaurate and $5.1\times10^{-4}$ mol/mol Ag of potassium thiocyanate. After chemical sensitization, gelatin was added to each of Emulsions B-1, B-2, B-3, B-4, B-5 and B-6 as a binder for coating. Then, the obtained emulsion was coated in the amount of 2 g/m$^2$.

The coated samples were Sample No. A-1, B-1, A-2, A-3, A-4, A-5, A-6, B-2, B-3, B-4, B-5 and B-6, respectively.

Independently, after chemical sensitization, each of the above emulsions was subject to spectral sensitization; namely, $2.5\times10^{-4}$ mol/mol Ag of the following spectral sensitizing dye (6) was added and the resulting emulsion was settled for 20 minute at 40° C. so that the dye might be adsorbed onto silver halide grains in the emulsion.

(6)

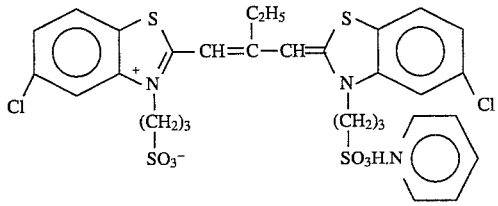

The emulsion thus obtained was coated in the amount of 2 g/m$^2$. The coated samples were No. A-1', B-1', A-2', A-3', A-4', A-5', A-6', B-2', B-3', B-4', B-5' and B-6', respectively.

After each Sample was exposed to blue light for $10^{-3}$ seconds using EG & G Sensitometer, the Sample was developed at 20° C. for 10 minutes with the following MAA-1 Developer.

| MAA-1 Developer | |
|---|---|
| Metol | 2.5 g |
| L-ascorbic acid | 10.0 g |
| Nabox | 35 g |
| KBr | 1.0 g |
| $H_2O$ | 1 litter |

The results are set forth in Table 1. In Table 1, the surface density means the density of the hexa-coordinated cyano-complex contained in surface parts of silver halide grains having the thickness of 20Å from the surfaces of the grains (mol per mol Ag). The density was measured using an aqueous solution of sodium thiosulfate as a silver halide solvent.

TABLE 1

| Emulsion | Colloid | Dopant | Surface Density | Sensitivity (*1) | Gradation (*2) | ΔlogE (*3) |
|---|---|---|---|---|---|---|
| A-1 | gelatin | — | — | 100 | 1.5 | −0.67 |
| B-1 | (1) | — | — | 90 | 1.4 | −0.65 |
| A-2 | gelatin | $[Fe(CN)_6]^{4-}$ | $1\times10^{-3}$ | 30 | 1.8 | −0.35 |
| A-3 | gelatin | $[Fe(CN)_6]^{3-}$ | $1\times10^{-3}$ | 25 | 1.7 | −0.37 |
| A-4 | gelatin | $[Ru(CN)_6]^{4-}$ | $1\times10^{-3}$ | 45 | 1.9 | −0.33 |
| A-5 | gelatin | $[Ir(CN)_6]^{3-}$ | $1\times10^{-3}$ | 50 | 1.8 | −0.35 |
| A-6 | gelatin | $[Fe(CN)_6]^{4-}$ | $2\times10^{-5}$ | 75 | 1.5 | −0.62 |
| B-2 | (1) | $[Fe(CN)_6]^{4-}$ | $1\times10^{-3}$ | 130 | 2.0 | −0.23 |
| B-3 | (1) | $[Fe(CN)_6]^{3-}$ | $1\times10^{-3}$ | 125 | 1.9 | −0.25 |

TABLE 1-continued

| Emulsion | Colloid | Dopant | Surface Density | Sensitivity (*1) | Gradation (*2) | ΔlogE (*3) |
|---|---|---|---|---|---|---|
| B-4 | (1) | $[Ru(CN)_6]^{4-}$ | $1 \times 10^{-3}$ | 135 | 2.1 | −0.22 |
| B-5 | (1) | $[Ir(CN)_6]^{3-}$ | $1 \times 10^{-3}$ | 125 | 2.0 | −0.17 |
| B-6 | (1) | $[Fe(CN)_6]^{4-}$ | $2 \times 10^{-5}$ | 95 | 1.4 | −0.60 |

(*1)The relative value of reciprocal of the exposure giving the density of 0.1 + fog (i.e., the density thicker than the fogged base by 0.1) in each of Samples A-1 to B-6, which had not been subjected to spectral sensitization.
(*2)The slope of straight line portion in the characteristic curve of each of Samples A-1 to B-6, which had not been subjected to spectral sensitization. The larger slope means the higher contrast.
(*3)The difference of the exposure giving the density of 0.1 + fog (i.e., the density thicker than the fogged base by 0.1) between Samples A-1 to B-6, which had not been subjected to spectral sensitization, and Samples A-1' to B-6', which had been subjected to spectral sensitization.

As is evident from Table 1, the photographic material of the invention exhibits high sensitivity and an image of high contrast, and is hardly desensitized by the spectral sensitizing dye. On the other hand, the sensitivity of the photographic material prepared using both gelatin and dopant is deteriorated by the interaction between the transition metal complex salt and gelatin.

EXAMPLE 2

Emulsion C-1: octahedral silver bromide emulsion prepared using gelatin (Comparison Example)

The titled emulsion was prepared in the reaction container equipped with a mixer. The procedure of the preparation of Emulsion A-1 was repeated except for the following procedure.

First, 1 wt. % aqueous solution of gelatin was added to Solutions 2, 4 and 6, and then Solutions 1, 2, 3, 4, 5 and 6 were introduced into the mixer. Also, 1 wt. % aqueous solution of gelatin (Solution 7) was added to the mixer to form an emulsion containing fine silver halide grains. Then, the obtained emulsion containing fine silver halide grains was supplied to the reaction container.

Emulsion D-1: octahedral silver bromide emulsion prepared using a synthetic polymer as a protective colloid (Comparison Example)

The procedure of the preparation of Emulsion C-1 was repeated except for using 2 g of the synthetic polymer represented by the following (7) instead of gelatin and for adding 1 wt. % aqueous solution of gelatin to Solutions 2, 4, 6 and 7.

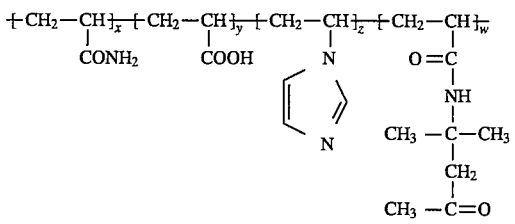

(7)

In the procedure, water-soluble salts were spontaneously precipitated and washed three times by decantation to be removed, and then the pH value of the obtained solution was adjusted to 6.3.

Emulsions C-2, C-3, C-4 and C-5: hexa-coordinated cyano-complex doped octahedral silver bromide emulsion prepared using gelatin (Comparison Example)

The procedure of the preparation of Emulsion C-1 was repeated except that $5\times10^{-4}$ M of each of the (2), (4) used in Example 1 and the following (8), (9) was dissolved in Solution 6 to prepare each of Emulsions C-2, C-3, C-4 and C-5, respectively.

$$K_3[CO(CN)_6] \quad (8)$$

$$K_4[Re(CN)_6] \quad (9)$$

Emulsion C-6: hexa-Coordinated cyano-complex slightly doped octahedral silver bromide emulsion prepared using gelatin (Comparison Example)

The procedure of the preparation of Emulsion C-1 was repeated except that $1\times10^{-5}$ M of the (2) used in Example 1 was dissolved in Solution 6 to prepare Emulsion C-6.

Emulsions D-2, D-3, D-4 and D-5: hexa-coordinated cyano-complex doped octahedral silver bromide emulsion prepared using a synthetic polymer as a protective colloid (Example)

The procedure of the preparation of Emulsion D-1 was repeated except that $5\times10^{-4}$ M of each of the (2), (4), (8) and (9) was dissolved in Solution 6 to prepare each of Emulsions D-2, D-3, D-4 and D-5, respectively.

Emulsion D-6: hexa-coordinated cyano-complex slightly doped octahedral silver bromide emulsion prepared using a synthetic polymer as a protective colloid (Comparison Example)

The procedure of the preparation of Emulsion D-1 was repeated except that $1\times10^{-5}$ M of the (2) was dissolved in Solution 6 to prepare Emulsion D-6.

Each of Emulsions C-1, D-1, C-2, C-3, C-4, C-5, C-6, D-2, D-3, D-4, D-5 and D-6 was subject to chemical sensitization using $1.2\times10^{-5}$ mol/mol Ag of sodium thiosulfate, $3.6\times10^{-6}$ mol/mol Ag of potassium chloroaurate and $5.1\times10^{-4}$ mol/mol Ag of potassium thiocyanate. After chemical sensitization, gelatin was added to each of Emulsions D-1, D-2, D-3, D-4, D-5 and D-6 as a binder for applying. Then, the obtained emulsion was coated in the amount of 2 g/m$^2$.

The coated samples were Samples No. C-1, D-1, C-2, C-3, C-4, C-5, C-6, D-2, D-3, D-4, D-5 and D-6, respectively.

Independently, after chemical sensitization, each of the above emulsions was subject to spectral sensitization; namely, $2.5\times10^{-4}$ mol/mol Ag of the above spectral sensitizing dye (6) was added and the resulting emulsion was settled for 20 minute at 40° C. so that the dye might be adsorbed onto silver halide grains in the emulsion.

The emulsion thus obtained was applied in the amount of 2 g/m$^2$. The obtained applied samples were named Samples C-1', D-1', C-2', C-3', C-4', C-5', C-6', D-2', D-3', D-4', D-5' and D-6', respectively.

After each sample was exposed to blue light for $10^{-3}$ seconds using EG & G Sensitometer, the Sample was developed at 20° C. for 10 minutes with the above MAA-1 Developer.

The results are set forth in Table 2. In Table 2, the surface density means the density of the hexa-coordinated cyano-complex contained in surface parts of silver halide grains having the thickness of 20Å from the surfaces of the grains (mol per mol Ag). The density was measured using an aqueous solution of sodium thiosulfate as a silver halide solvent.

TABLE 2

| Emulsion | Colloid | Dopant | Surface Density | Sensitivity (*1) | Gradation (*2) | ΔlogE (*3) |
|---|---|---|---|---|---|---|
| C-1 | gelatin | — | — | 100 | 1.5 | −0.67 |
| D-1 | (7) | — | — | 85 | 1.3 | −0.60 |
| C-2 | gelatin | $[Fe(CN)_6]^{4-}$ | $1 \times 10^{-3}$ | 30 | 1.8 | −0.35 |
| C-3 | gelatin | $[Ru(CN)_6]^{4-}$ | $1 \times 10^{-3}$ | 45 | 1.9 | −0.33 |
| C-4 | gelatin | $[Co(CN)_6]^{3-}$ | $1 \times 10^{-3}$ | 20 | 1.9 | −0.40 |
| C-5 | gelatin | $[Re(CN)_6]^{4-}$ | $1 \times 10^{-3}$ | 25 | 1.9 | −0.38 |
| C-6 | gelatin | $[Fe(CN)_6]^{4-}$ | $2 \times 10^{-5}$ | 75 | 1.5 | −0.62 |
| D-2 | (7) | $[Fe(CN)_6]^{4-}$ | $1 \times 10^{-3}$ | 130 | 2.0 | −0.23 |
| D-3 | (7) | $[Ru(CN)_6]^{4-}$ | $1 \times 10^{-3}$ | 135 | 2.1 | −0.22 |
| D-4 | (7) | $[Co(CN)_6]^{3-}$ | $1 \times 10^{-3}$ | 125 | 2.1 | −0.25 |
| D-5 | (7) | $[Re(CN)_6]^{4-}$ | $1 \times 10^{-3}$ | 140 | 2.0 | −0.20 |
| D-6 | (7) | $[Fe(CN)_6]^{4-}$ | $2 \times 10^{-5}$ | 90 | 1.3 | −0.55 |

(*1)The relative value of reciprocal of the exposure giving the density of 0.1 + fog (i.e., the density thicker than the fogged base by 0.1) in each of Samples C-1 to D-6, which had not been subjected to spectral sensitization.
(*2)The slope of straight line portion in the characteristic curve of each of Samples C-1 to D-6, which had not been subjected to spectral sensitization. The larger slope means the higher contrast.
(*3)The difference of the exposure giving the density of 0.1 + fog (i.e., the density thicker than the fogged base by 0.1) between Samples C-1 to D-6, which had not been subjected to spectral sensitization, and Samples C-1' to D-6', which had been subjected to spectral sensitization.

As is evident from Table 2, the photographic material of the invention exhibits high sensitivity and an image of high contrast, and further is hardly desensitized by the spectral sensitizing dye. On the other hand, the sensitivity of the photographic material prepared using both gelatin and dopant is deteriorated by the interaction between the transition metal complex salt and gelatin.

We claim:

1. A silver halide photographic material which comprises a support and a silver halide emulsion layer provided thereon, wherein the silver halide emulsion is prepared by nuclear formation, crystal growth and chemical sensitization, all or a part of the nuclear formation or the crystal growth being conducted in the presence of a hexa-coordinated cyano-complex to introduce the complex into crystal lattice of the silver halide, the hexa-coordinated cyano-complex contained in surface parts of silver halide grains having a density in the range of $5\times10^{-4}$ to $10^{-2}$ mol per 1 mol of silver, said surface parts of silver halide grains having a thickness of not more than 20Å from surfaces of the grains, the chemical sensitization being conducted using a gold sensitizer, and the silver halide emulsion being prepared using a synthetic polymer as a protective colloid in place of gelatin which is absent or present in an amount of not more than 10 g per 1 mol of silver.

2. The silver halide photographic material as claimed in claim 1, wherein the silver halide emulsion is prepared in the absence of gelatin.

3. The silver halide photographic material as claimed in claim 1, wherein all or a part of the nuclear formation or the crystal growth is conducted by supplying fine silver halide grains, which are prepared using a synthetic polymer as a protective colloid.

4. The silver halide photographic material as claimed in claim 1, wherein the hexa-coordinated cyano-complex is a salt containing a hexa-coordinated transition metal complex anion represented by the formula (I):

$$[M(CN)_6]^{n-} \quad \text{(I)}$$

wherein M is a transition metal selected from those consisting of metals of the fifth, sixth, seventh, eighth, ninth and tenth groups of the fourth, fifth and sixth periods in the periodic table; and n is 3 or 4.

5. The silver halide photographic material as claimed in claim 4, wherein M in the formula (I) is iron, cobalt, ruthenium, rhenium, rhodium, osmium or iridium.

6. The silver halide photographic material as claimed in claim 4, wherein the hexa-coordinated cyano-complex is a salt of ammonium or an alkali metal with a hexa-coordinated transition metal complex anion represented by the formula (I).

7. The silver halide photographic material as claimed in claim 1, wherein the hexa-coordinated cyano-complex is used in an amount of $10^{-8}$ to $10^{-2}$ mol per 1 mol of silver.

8. The silver halide photographic material as claimed in claim 1, wherein the synthetic polymer is polyacrylamide, an amino polymer, a thioether polymer, polyvinyl alcohol, polyacrylic acid, polyacrylic ester, a hydroxyquinoline polymer, a cellulose derivative, a starch derivative, an acetal polymer, polyvinyl pyrrolidone, polystyrene or an imidazole polymer.

9. The silver halide photographic material as claimed in claim 1, wherein the synthetic polymer is use in an amount of not more than 150 g per 1 mol of silver.

10. The silver halide photographic material as claimed in claim 1, wherein the gold sensitizer is used in an amount of $10^{-7}$ to $10^{-2}$ mol per 1 mol of silver.

11. The silver halide photographic material as claimed in claim 1, wherein a chalcogen sensitizer is used in combination with the gold sensitizer.

* * * * *